US005797408A

United States Patent [19]

Wilson

[11] Patent Number: 5,797,408

[45] Date of Patent: Aug. 25, 1998

[54] HAIR ACCESSORY WITH PIERCEABLE ORNAMENT HOLDER

[76] Inventor: Jackie Ann Wilson, 4226 Highway 18 S., Morganton, N.C. 28655

[21] Appl. No.: 908,991

[22] Filed: Aug. 8, 1997

[51] Int. Cl.[6] ..... A45D 8/00

[52] U.S. Cl. ..... 132/275; 132/277

[58] Field of Search ..... 132/275, 245, 132/246, 273, 276, 277, 280, 281; 63/23, 12, 13

[56] References Cited

U.S. PATENT DOCUMENTS

| | | | |
|---|---|---|---|
| 421,682 | 2/1890 | Dickinson | 132/275 |
| 1,373,968 | 4/1921 | McClintock | 132/245 |
| 1,523,962 | 1/1925 | Hitzigrath | 132/246 |
| 2,066,709 | 1/1937 | Adams | 132/246 |
| 2,524,562 | 10/1950 | Dawbarn | 132/231 |
| 3,542,041 | 11/1970 | Mercorella | 132/275 |
| 3,842,849 | 10/1974 | Goodman | 132/273 |
| 3,975,921 | 8/1976 | Pomaski | 63/13 |
| 4,107,824 | 8/1978 | Lussier | 24/27 |
| 4,406,296 | 9/1983 | Wexler et al. | 132/148 |
| 4,987,667 | 1/1991 | Zwart | 63/12 |
| 5,655,224 | 8/1997 | Sears | 132/273 |

*Primary Examiner*—Todd E. Manahan
*Assistant Examiner*—Eduardo C. Robert
*Attorney, Agent, or Firm*—Adams Law Firm, P.A.

[57] ABSTRACT

A hair accessory is adapted for being retained in the hair of a wearer to support an ornament therefrom. The hair accessory includes a body and an elongate leg. The leg extends outwardly from the body, and includes a foot defining an insertion site for suspending the ornament therefrom.

11 Claims, 3 Drawing Sheets

HAIR ACCESSORY WITH PIERCEABLE ORNAMENT HOLDER

TECHNICAL FIELD AND BACKGROUND OF THE INVENTION

This invention relates to a hair accessory for being worn in the hair to support a light weight ornament, such as an earring or other decorative item. The invention is a fashionable accessory which is relatively inexpensive to manufacture and easy to use. The ornament suspended from the accessory can be selected to match earrings and other items of jewelry and clothing, and is quickly and conveniently interchanged with other ornaments. The invention is comfortable to wear and easily removed from and applied to the hair.

SUMMARY OF THE INVENTION

Therefore, it is an object of the invention to provide a hair accessory which is comfortably worn in the hair to support one or more light weight ornaments, such as conventional earrings.

It is another object of the invention to provide a hair accessory which is applicable for being worn in the hair by itself without an ornament or other decorative item.

It is another object of the invention to provide a hair accessory which is readily applied to and removed from the hair.

It is another object of the invention to provide a hair accessory which is relatively inexpensive to manufacture.

It is another object of the invention to provide a hair accessory which is securely held in the hair during wear.

It is another object of the invention to provide a hair accessory which is attachable directly to a hair pin, clip, barrette, or other item for holding the hair in place.

It is another object of the invention to provide a hair accessory which is light weight.

These and other objects of the present invention are achieved in the preferred embodiments disclosed below by providing a hair accessory adapted for being retained in the hair of a wearer to support an ornament therefrom. The hair accessory includes a body and attachment means. The attachment means cooperates with the body for suspending the ornament therefrom.

According to one preferred embodiment of the invention, the attachment means includes an elongate leg extending outwardly from the body.

According to another preferred embodiment of the invention, a foot is formed at a free end of the leg and defines an insertion site for receiving an attachment member of the ornament.

According to yet another preferred embodiment of the invention, the foot includes a thermoplastic coating at the insertion site.

According to yet another preferred embodiment of the invention, a decorative outer cover is formed around the body.

According to yet another preferred embodiment of the invention, the outer cover includes a fabric wrapping.

According to yet another preferred embodiment of the invention, the body includes an elongate shape-retaining pliable member formed in a circle. The body has first and second ends movable between an open position for applying and removing the accessory to and from the hair, and a closed position for retaining the accessory in the hair.

According to yet another preferred embodiment of the invention, the attachment means includes first and second legs extending from respective first and second ends of the body.

According to yet another preferred embodiment of the invention, a foot is formed at each free end of the leg, and defines an insertion site for receiving an attachment member of the ornament.

According to yet another preferred embodiment of the invention, each foot includes a thermoplastic coating at the insertion site.

An embodiment of the method according to the invention comprises the steps of securing a body of the hair accessory in the hair of the wearer, and providing attachment means cooperating with the body for suspending the ornament therefrom.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
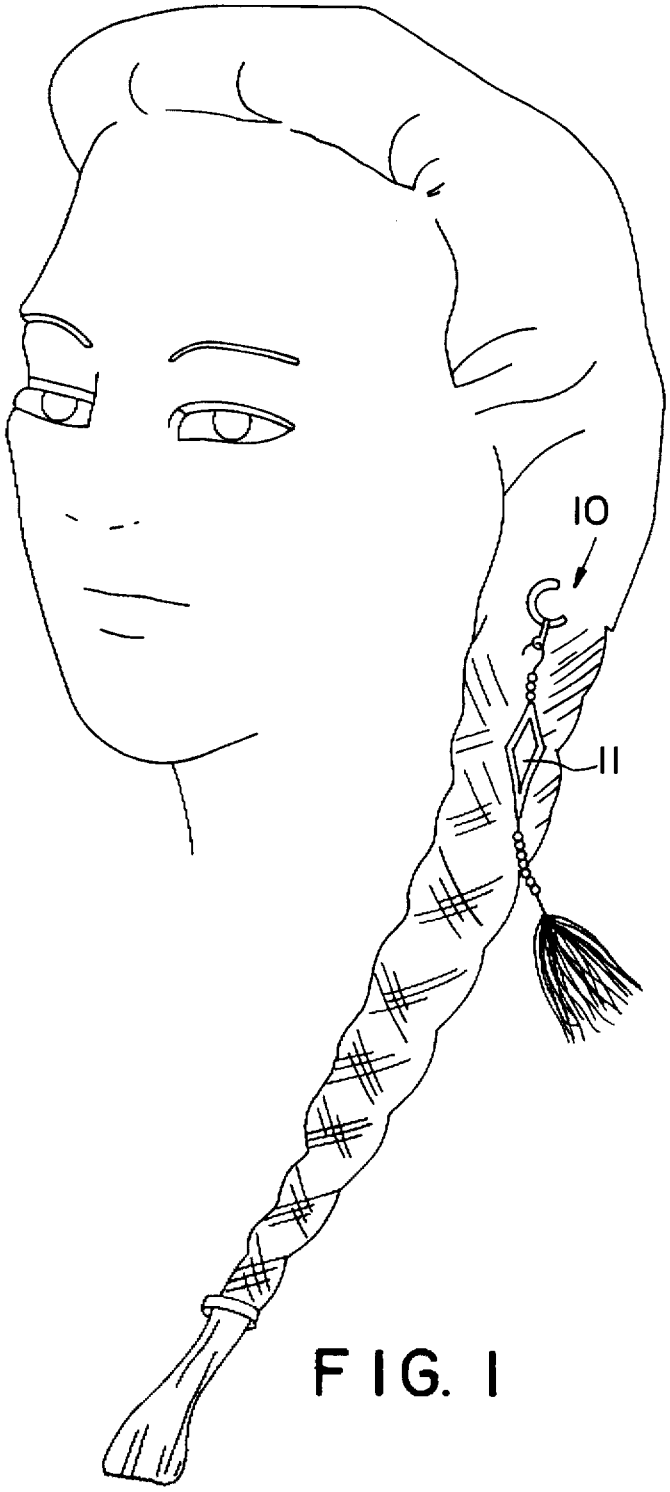
FIG. 1 is a perspective view of the hair accessory according to one embodiment of the invention, and showing the accessory as worn in the hair of a wearer.

Referring now specifically to the drawings, a hair accessory according to the present invention is illustrated in FIG. 1 and shown generally at reference numeral 10. Preferably, the accessory 10 encircles a portion of braided hair to retain the accessory 10 in the hair while carrying a light weight ornament 11, such as an earring or other decorative item. Alternatively, the accessory 10 may be secured directly to a hair pin, clip, barrette, or other item for holding the hair in place. One or more ornaments 11 may be suspended from the accessory 10 at one time. Moreover, ornaments 11 may be added or removed from the accessory 10 without first removing the accessory 10 from the hair.

Figure 2:
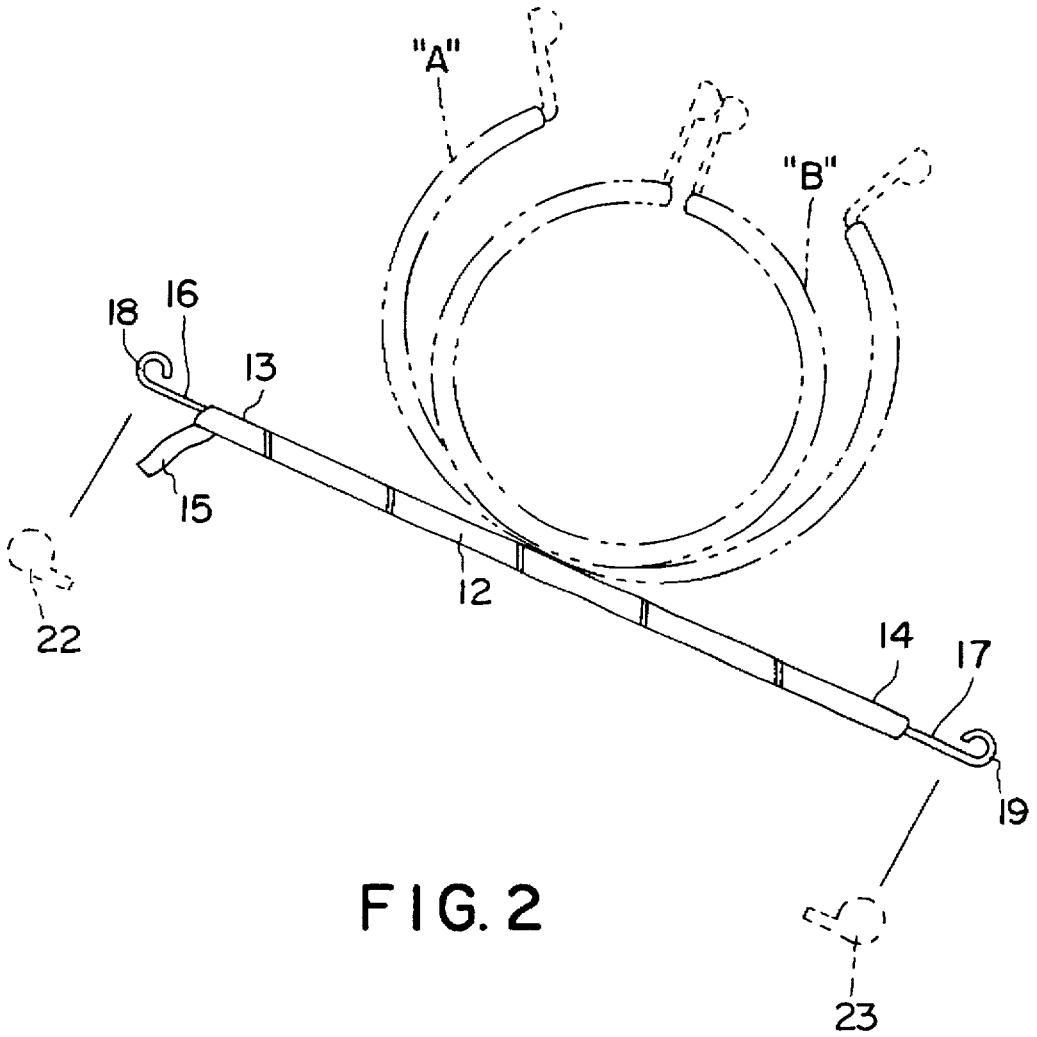
FIG. 2 is a view of the wire body of the accessory in a straightened condition before being formed into a circular shape, and showing respective open and closed positions of the body in phantom.

As shown in FIG. 2, the body 12 of the accessory 10 includes a pliable elongate wire which is formed in the shape of a circle, and which is sufficiently resilient to retain its circular shape when applied to the hair. The wire body 12 has first and second ends 13 and 14 movable between an open position. All for applying the accessory to the hair, and a closed position "B" for retaining the accessory 10 in the hair. Preferably, a multi-colored outer cover 15 formed of silk or other fabric is wrapped around the wire body 12 for added decoration, and to prevent the accessory 10 from pulling on the hair when being removed.

Figure 3:
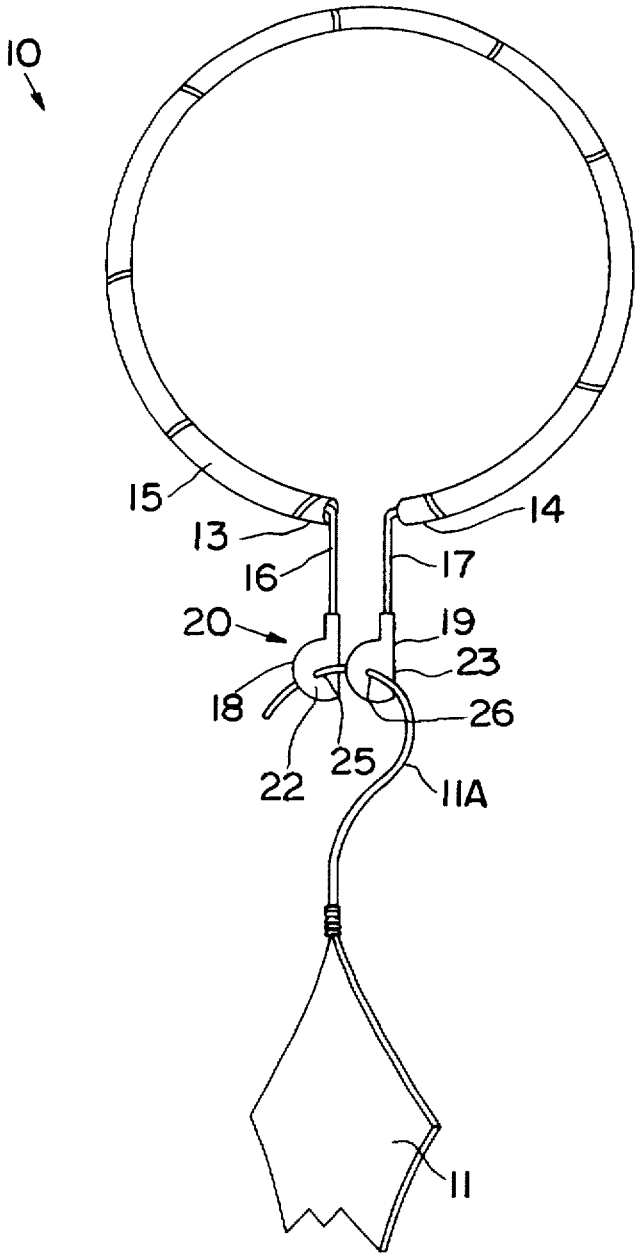
FIG. 3 is perspective view of the hair accessory with the body in the closed position and the ornament suspended therefrom.

First and second legs 16 and 17 extend from respective ends 13 and 14 of the wire body 12, and radially outwardly from the body 12 when formed in its circular shape as described above. Each leg 16 and 17 includes a foot 18 and 19 integrally formed at its free end, and defining an insertion site 20 for receiving an attachment member 11A of the ornament 11 to suspend the ornament 11 from the accessory 10 as shown in FIGS. 1 and 3. Each foot 18 and 19 preferably includes a thermoplastic or rubber outer coating 22 and 23 which is pierced by the attachment member 11A at the insertion site 20 to form small openings 25 and 26 in the coated feet 18 and 19, respectively. The attachment member 11A extends through the small openings 25 and 26, and is frictionally held in place at the insertion site 20 to further secure the ornament 11 to the accessory 10 during wear. The attachment member 11A holds the legs 16 and 17 together and locks the body 12 in the closed position around the hair. The accessory 10 is taken out of the hair by sliding the attachment member 11A outwardly from the openings 25 and 26 formed in the feet 18 and 19, and then flexing the body 12 to the open position to separate the legs 16 and 17 as shown in FIG. 2.

A hair accessory is described above. Various details of the invention may be changed without departing from its scope. Furthermore, the foregoing description of the preferred embodiment of the invention and the best mode for practicing the invention are provided for the purpose of illustration only and not for the purpose of limitation-the invention being defined by the claims.

I claim:

1. A hair accessory adapted for being retained in the hair of a wearer to support an ornament therefrom, said hair accessory comprising:

(a) a body; and (b) attachment means cooperating with said body for suspending the ornament therefrom, said attachment means comprising an elongate leg extending outwardly from said body, and a foot formed at a free end of said leg and having an opening defining an insertion site for receiving a semi-rigid attachment member of the ornament, said foot including a pierceable coating covering the opening at the insertion site and being pierced by an end of the attachment member to secure the ornament to the accessory during wear.

2. A hair accessory according to claim 1, and including a decorative outer cover, formed around said body.

3. A hair accessory according to claim 1, wherein said outer cover comprises a fabric wrapping.

4. A hair accessory according to claim 1, wherein said body comprises an elongate shape-retaining pliable member formed in a circle, and having first and second ends movable between an open position for applying and removing the accessory to and from the hair, and a closed position for retaining the accessory in the hair.

5. A hair accessory according to claim 4, wherein said attachment means further comprises a second leg and each of said legs of said attachment means extends from a respective one of said first and second ends of the body.

6. A hair accessory adapted for being retained in the hair of a wearer to support an ornament therefrom, said hair accessory comprising:

(a) a body comprising an elongate shape-retaining pliable member formed in a circle, and having first and second ends movable between an open position for applying and removing the accessory to and from the hair, and a closed position for retaining the accessory in the hair; and (b) first and second legs extending from respective first and second ends of the body, and having respective first and second feet formed at free ends of the legs each of said feet having an opening defining an insertion site for receiving an attachment member of the ornament, and a pierceable coating covering the opening at the insertion site and being pierced by an end of the attachment member to secure the ornament to the accessory during wear; and (c) a decorative outer cover formed around said body.

7. A hair accessory according to claim 6, wherein said outer cover comprises a fabric wrapping.

8. In combination with an ornament including a semi-rigid attachment member, a hair accessory adapted for being retained in the hair of a wearer to support the ornament therefrom, said hair accessory comprising:

(a) a pliable body having first and second ends, and adapted for (b) attachment means cooperating with said body for suspending the ornament therefrom, said attachment means comprising first and second elongate legs extending outwardly from respective ends of said body, and first and second feet formed at respective free ends of said legs and defining an insertion site for receiving the attachment body in the hair of the wearer.

9. A combination according to claim 8, and including a decorative outer cover formed around said body.

10. A combination according to claim 8, wherein said body comprises an elongate shape-retaining pliable member formed in a circle, said first and second ends being movable between an open position for applying and removing the accessory to and from the hair, and a closed position for retaining the accessory in the hair.

11. A method of suspending an ornament having a semi-rigid attachment member from a hair accessory adapted for being retained in the hair of a wearer, comprising the steps of:

(a) securing a body of the hair accessory to the hair of the wearer;

(b) providing attachment means cooperating with the body for suspending the ornament therefrom, said attachment means compromising an elongate leg extending outwardly from said body, and a foot formed at a free end of said leg and having an said foot including a pierceable coating covering the opening the insertion site: and (c) piercing the coating by inserting an end of the attachment member of the ornament through the insertion site to secure the ornament to the accessory during wear.

* * * * *